US011761213B2

(12) United States Patent
Esquilin-Mangual et al.

(10) Patent No.: US 11,761,213 B2
(45) Date of Patent: Sep. 19, 2023

(54) FRAME AND STAIR SYSTEMS AND METHODS

(71) Applicant: United States of America as Represented by The Secretary of The Army, Alexandria, VA (US)

(72) Inventors: Omar Esquilin-Mangual, Vicksburg, MS (US); Catherine S Stephens, Clinton, MS (US); Omar G Flores, Vicksburg, MS (US); Andrew B Edwards, Toney, AL (US); Nicholas R Boone, Vicksburg, MS (US)

(73) Assignee: UNITED STATES OF AMERICA AS REPRESENTED BY THE SECRETARY OF THE ARMY, Alexandria, VA (US)

( * ) Notice: Subject to any disclaimer, the term of this patent is extended or adjusted under 35 U.S.C. 154(b) by 0 days.

(21) Appl. No.: 17/035,332

(22) Filed: Sep. 28, 2020

(65) Prior Publication Data

US 2022/0098869 A1 Mar. 31, 2022

(51) Int. Cl.

| | |
|---|---|
| ***E04F 11/022*** | (2006.01) |
| ***E04F 11/18*** | (2006.01) |
| *E04G 13/06* | (2006.01) |

(52) U.S. Cl.

CPC ..... *E04F 11/022* (2013.01); *E04F 11/18* (2013.01); *E04G 13/062* (2013.01)

(58) Field of Classification Search

CPC ... E04F 11/022; E04F 11/0226; E04F 11/025; E04F 11/0255; E04F 11/18; E04G 13/062; E04G 27/00; E04G 1/34; E06C 1/397

USPC ..... 52/182, 188, 191

See application file for complete search history.

(56) References Cited

U.S. PATENT DOCUMENTS

| | | | | |
|---|---|---|---|---|
| 1,458,866 A * | 6/1923 | Wetzel | E04H 3/126 | 52/638 |
| 1,744,137 A * | 1/1930 | Oberdorfer | E04H 3/12 | 52/182 |
| 1,746,147 A * | 2/1930 | Duke | E04H 3/12 | 52/654.1 |
| 2,879,552 A * | 3/1959 | Torrance | E04G 1/14 | 52/637 |
| 3,077,642 A * | 2/1963 | Forsythe | E04H 3/12 | 52/191 |
| 6,763,912 B2 * | 7/2004 | Robinson | E04F 11/025 | 182/113 |

(Continued)

*Primary Examiner* — William V Gilbert

(74) *Attorney, Agent, or Firm* — Brian C. Jones

(57) ABSTRACT

In one embodiment, a frame and stair system for engaging a wall includes multiple pad assemblies, a distal frame assembly, a lower proximal frame assembly, an upper proximal frame assembly, multiple stair assemblies, and multiple upper panel stair adapter brackets. A lower stair assembly is coupled with a left stair pad assembly, a right stair pad assembly, a left distal leveling pad, and a right distal leveling pad. A middle stair assembly is coupled with the distal frame assembly and the upper proximal frame assembly. An upper stair assembly is coupled with the upper proximal frame assembly. The upper proximal frame assembly is coupled with the lower proximal frame assembly. A left upper panel stair adapter bracket and a right upper panel stair adapter bracket are coupled with the upper stair assembly and are configured to engage an upper edge of the wall.

23 Claims, 19 Drawing Sheets

(56) References Cited

U.S. PATENT DOCUMENTS

| | | | | |
|---|---|---|---|---|
| 8,464,493 | B2 * | 6/2013 | Boone | E04B 1/3483 52/646 |
| 2008/0196330 | A1 * | 8/2008 | Frank | E04H 3/12 52/182 |
| 2009/0031648 | A1 * | 2/2009 | Van Stokkum | E04H 3/12 52/182 |
| 2020/0123780 | A1 * | 4/2020 | Harrison | A47B 43/00 |

* cited by examiner

FRAME AND STAIR SYSTEMS AND METHODS

STATEMENT OF GOVERNMENT INTEREST

Under paragraph 1(a) of Executive Order 10096, the conditions under which this invention was made entitle the Government of the United States, as represented by the Secretary of the Army, to an undivided interest therein on any patent granted thereon by the United States. This and related patents are available for licensing to qualified licensees.

BACKGROUND

Field of the Invention

The present invention relates to frame and stair structures, and, more particularly but not exclusively, to frame and stair systems and methods for use with modular protective systems.

Description of the Related Art

This section introduces aspects that may help facilitate a better understanding of the invention. Accordingly, the statements of this section are to be read in this light and are not to be understood as admissions about what is prior art or what is not prior art.

Stair systems are well known in the construction industry, and are helpful in providing access to different floors within a building. Yet still further improvements in stair technology are desired. Embodiments of the present invention provide solutions for at least some of these outstanding needs.

SUMMARY

The present invention was developed to address the challenges associated with existing modular protective systems and related overhead cover systems. For example, frame and stair systems as disclosed herein are well suited for use in providing safe and reliable access to modular protective systems and related overhead cover systems, and can also be used to facilitate the construction of modular protective systems and related overhead cover systems. Research and development has led to a novel approach for fabricating frame and stair systems as disclosed herein.

The present invention advances the science of frame and stair systems and methods. This disclosure describes a new frame and stair system that can be used with modular protective systems and related overhead cover systems. Particular focus will be placed on the ease in which the frame and stair system can be assembled, and the versatility in which the frame and stair system can be used with modular protective systems and related overhead cover systems. The frame and stair systems presented here are shown to be more versatile, adaptable, and effective than prior devices. What is more, the instant frame and stair systems are simple in construction, economical to fabricate, and easy to use, particularly in a time-efficient manner.

BRIEF DESCRIPTION OF THE DRAWINGS

Embodiments of the invention will become more fully apparent from the following detailed description, the appended claims, and the accompanying drawings in which like reference numerals identify similar or identical elements.

DETAILED DESCRIPTION

Detailed illustrative embodiments of the present invention are disclosed herein. However, specific structural and functional details disclosed herein are merely representative for purposes of describing example embodiments of the present invention. The present invention may be embodied in many alternate forms and should not be construed as limited to only the embodiments set forth herein. Further, the terminology used herein is for the purpose of describing particular embodiments only and is not intended to be limiting of example embodiments of the invention.

As used herein, the singular forms "a," "an," and "the," are intended to include the plural forms as well, unless the context clearly indicates otherwise. It further will be understood that the terms "comprises," "comprising," "includes," and/or "including," specify the presence of stated features, steps, or components, but do not preclude the presence or addition of one or more other features, steps, or components. It also should be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

In at least one embodiment, the present invention aims to address the shortcoming of existing stair systems by providing a frame and stair system that can easily be used with a wide variety of modular protective systems and/or overhead cover systems.

Figure 1A:
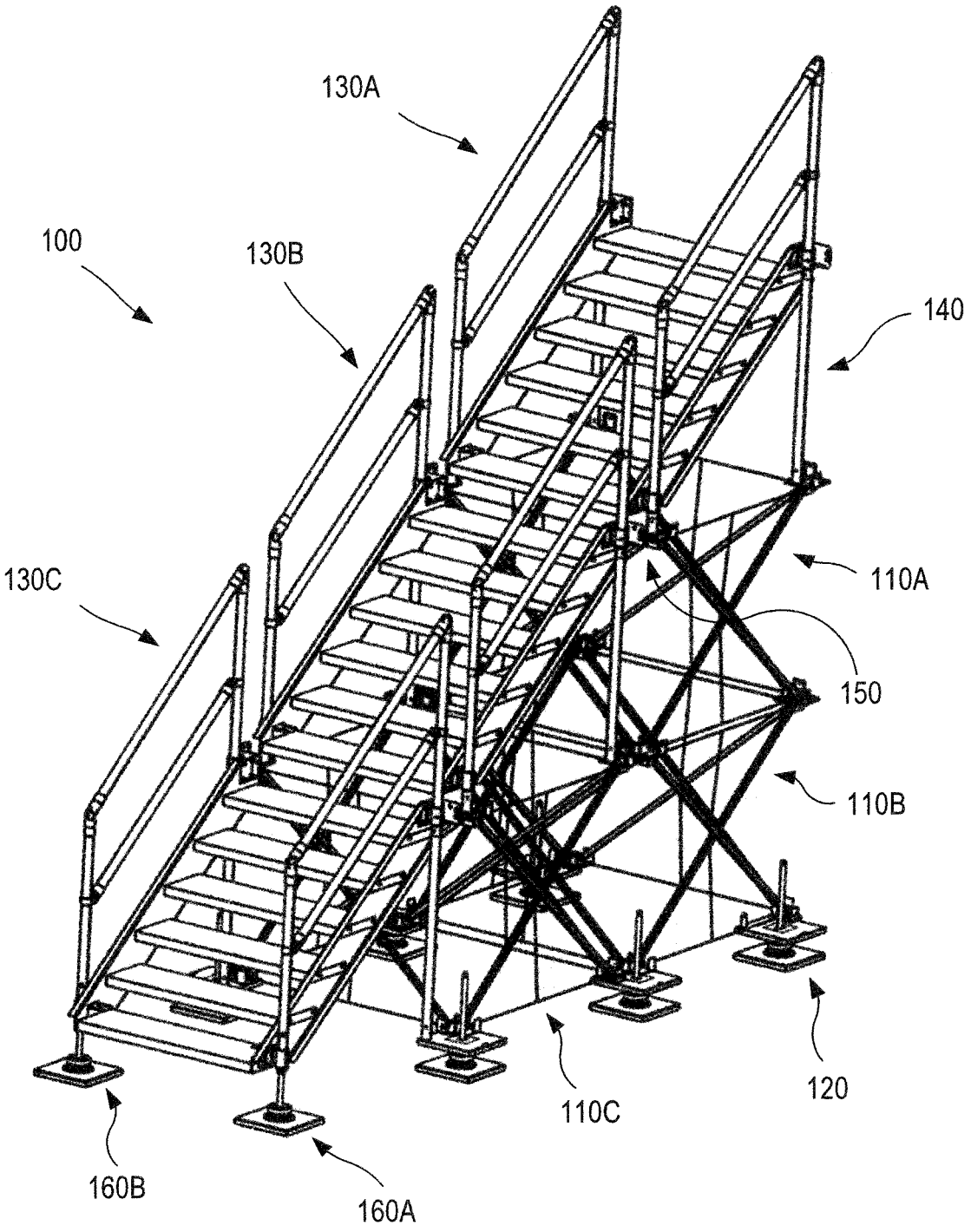
FIG. 1A depicts aspects of a frame and stair system according to certain embodiments of the invention.

Turning now to the drawings, FIG. 1A depicts aspects of a frame and stair system 100 according to embodiments of the present invention. As shown here, frame and stair system 100 includes three frame assemblies 110A, 110B, and 1100. Frame assembly 110A is provided as an upper proximal frame assembly, frame assembly 110B is provided as a lower proximal frame assembly, and frame assembly 110C is provided as a lower distal frame assembly. Frame and stair system 100 also includes six leveling pad assemblies (e.g. 120). In the embodiment depicted here, the frame and stair system 100 includes a left distal leveling pad assembly, a right distal leveling pad assembly, a left middle leveling pad assembly, a right middle leveling pad assembly, a left proximal leveling pad assembly, and a right proximal leveling pad assembly. Further, frame and stair system 100 includes three stair assemblies 130A, 130B, and 130C. Stair assembly 130A is provided as an upper stair assembly, stair assembly 130B is provided as a center stair assembly, and stair assembly 130C is provided as a lower stair assembly. Frame and stair system 100 also includes six stair legs (e.g. 140). Frame and stair system 100 further includes four stair assembly receivers (e.g. 150). What is more, frame and stair system 100 includes two stair pad assemblies (right stair pad assembly 160A and left stair pad assembly 160B).

According to some embodiments, frame and stair system 100 can be used in conjunction with a platform unit, for example as described in U.S. Patent Publication No. 2011/0005695, the content of which is incorporated herein by reference. According to some embodiments, frame and stair system 100 can be used in conjunction with a platform unit or protective wall, for example as described in U.S. Pat. No. 8,464,493, the content of which is incorporated herein by reference. According to some embodiments, frame and stair system 100 can be used in conjunction with a platform unit, wall, or joist assembly, for example as described in U.S. Patent Publication No. 2014/0130438, the content of which is incorporated herein by reference.

Figure 1B:
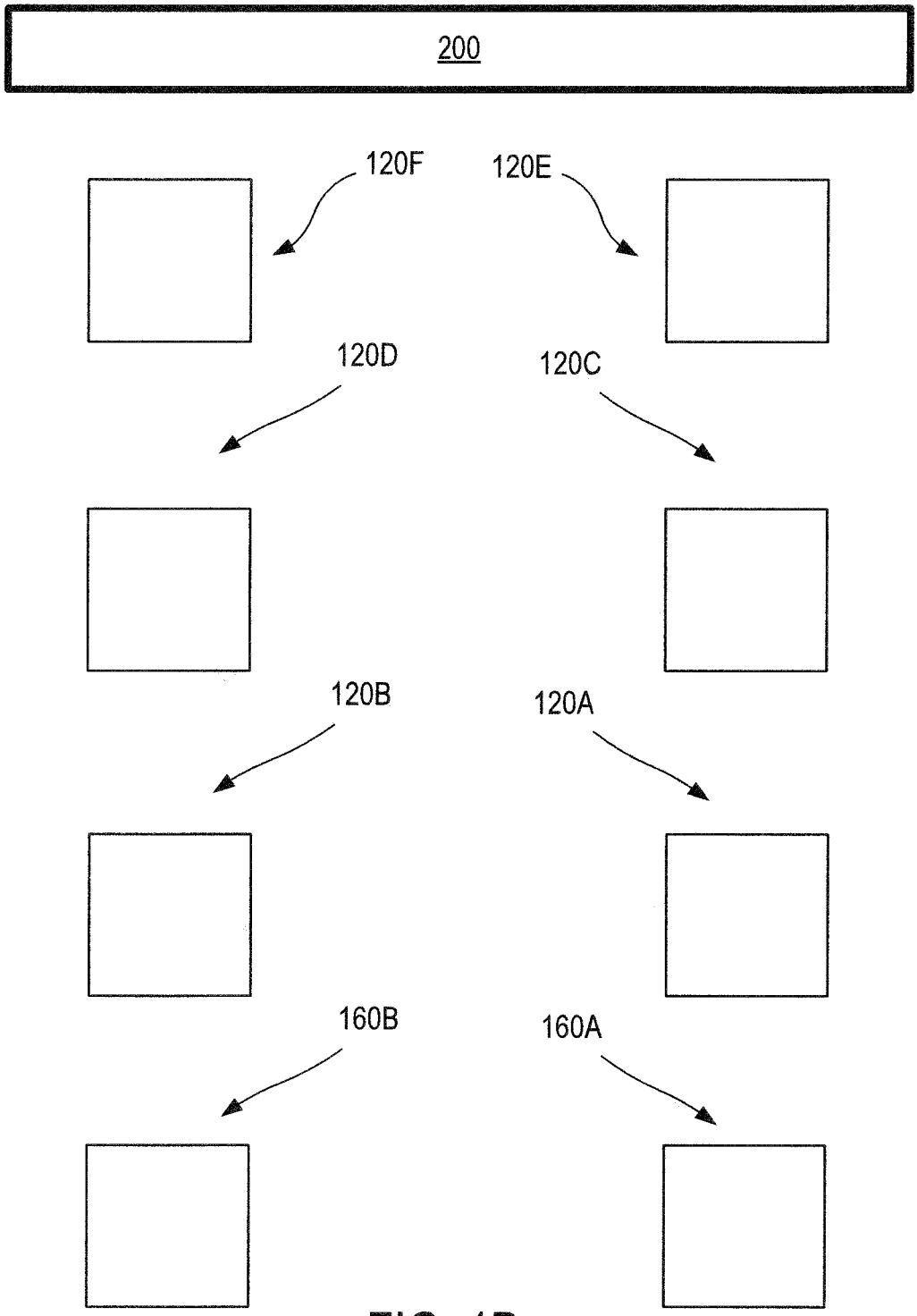
FIG. 1B depicts aspects of a frame and stair system according to certain embodiments of the invention.

An exemplary assembly method can begin placing two stair pad assemblies (e.g. 160A, 160B) on the ground at an assembly site, along with six leveling pad assemblies (e.g. 120). For example, FIG. 1B provides a top plan view depicting placement of a left stair pad assembly 160B, a right stair pad assembly 160A, a left distal leveling pad assembly 120B, a right distal leveling pad assembly 120A, a left middle leveling pad assembly 120D, a right middle leveling pad assembly 120C, a left proximal leveling pad assembly 120F, and a right proximal leveling pad assembly 120E, relative to a wall 200.

Figure 2A:
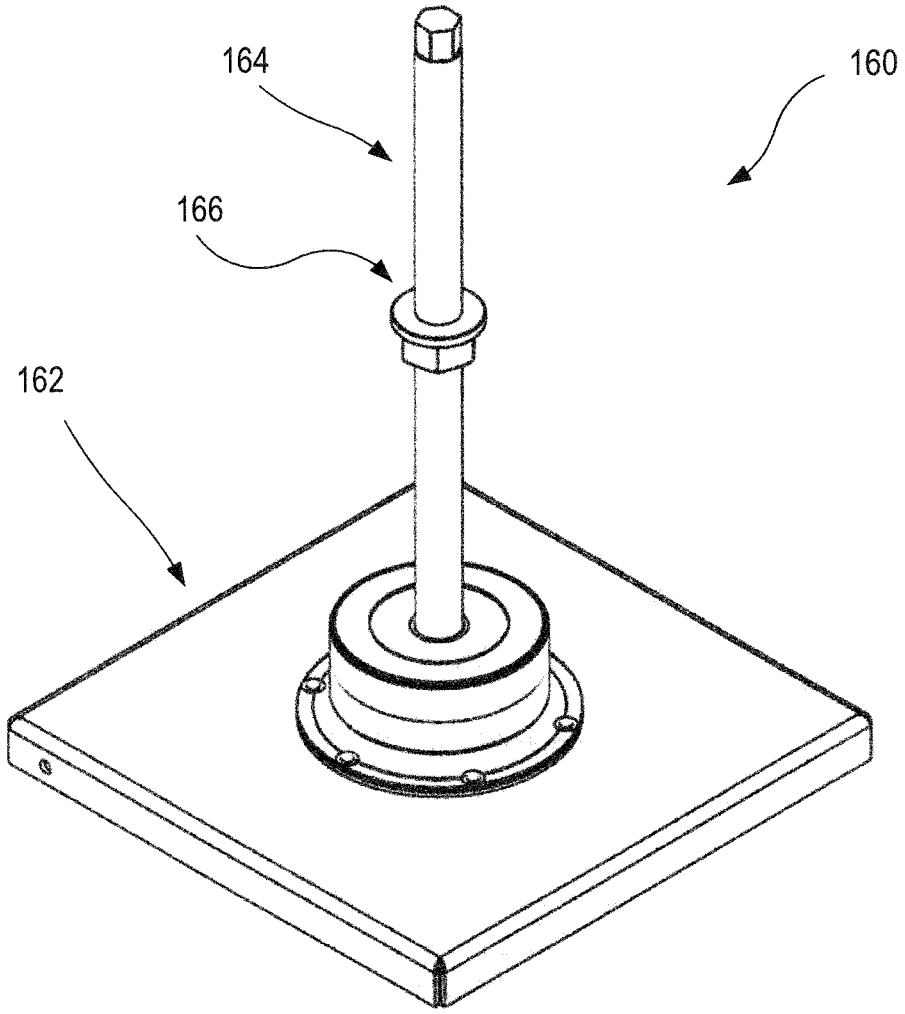
FIG. 2A illustrates aspects of a stair pad assembly according to certain embodiments of the invention.
Figure 2B:
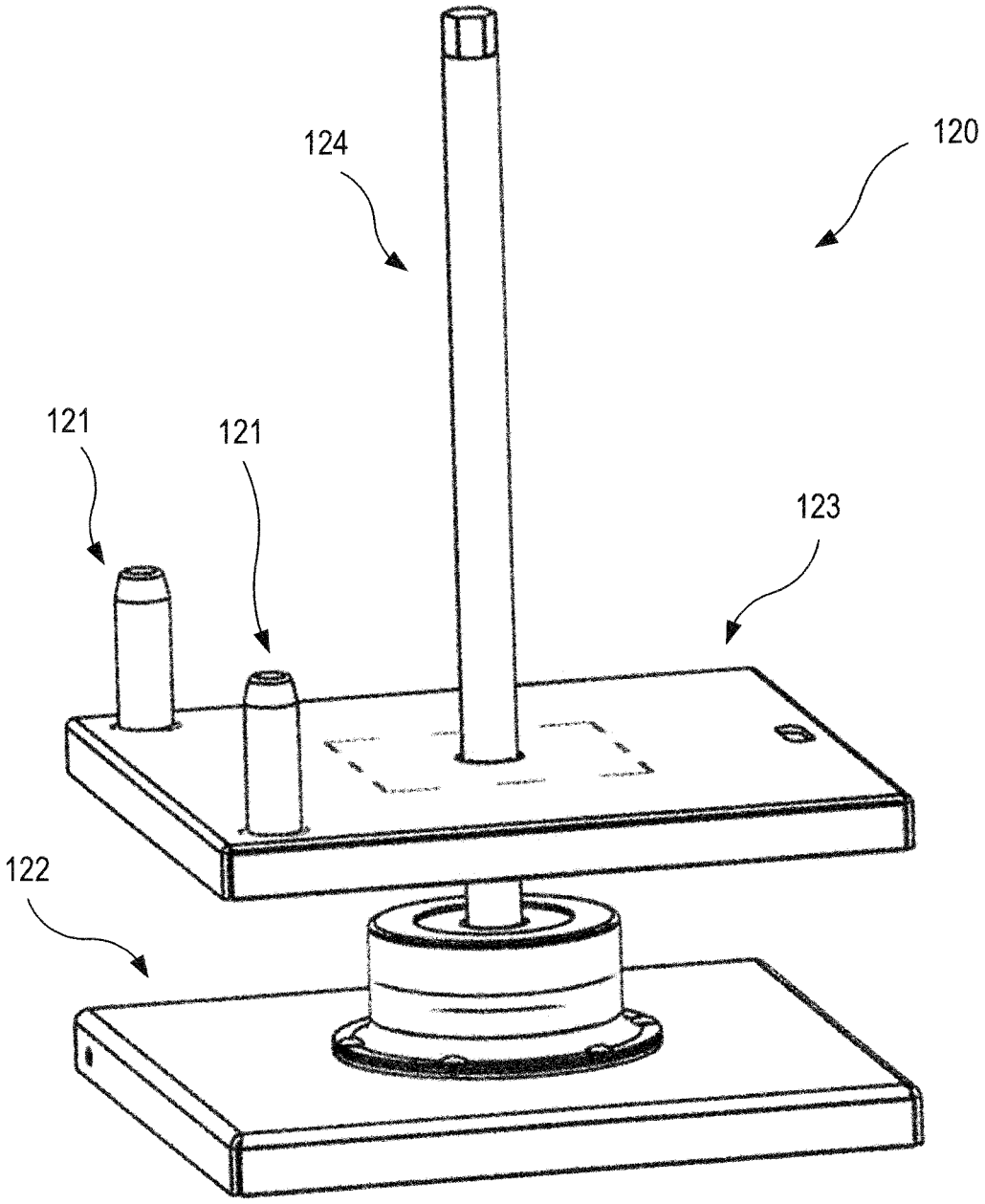
FIG. 2B illustrates aspects of a leveling pad assembly according to certain embodiments of the invention.
Figure 3:
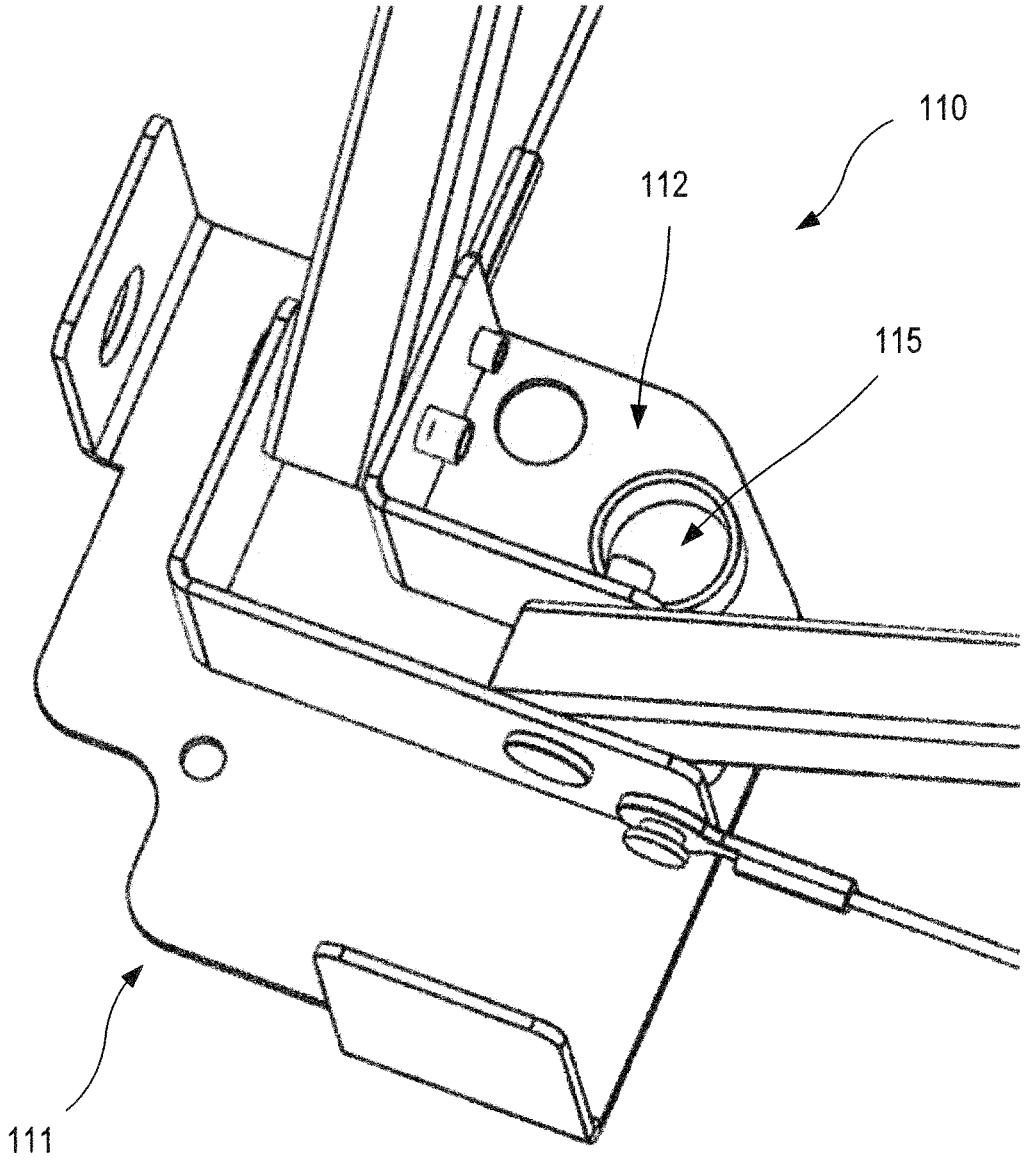
FIG. 3 illustrates aspects of a lower frame attachment mechanism of a frame assembly according to certain embodiments of the invention.
Figure 4:
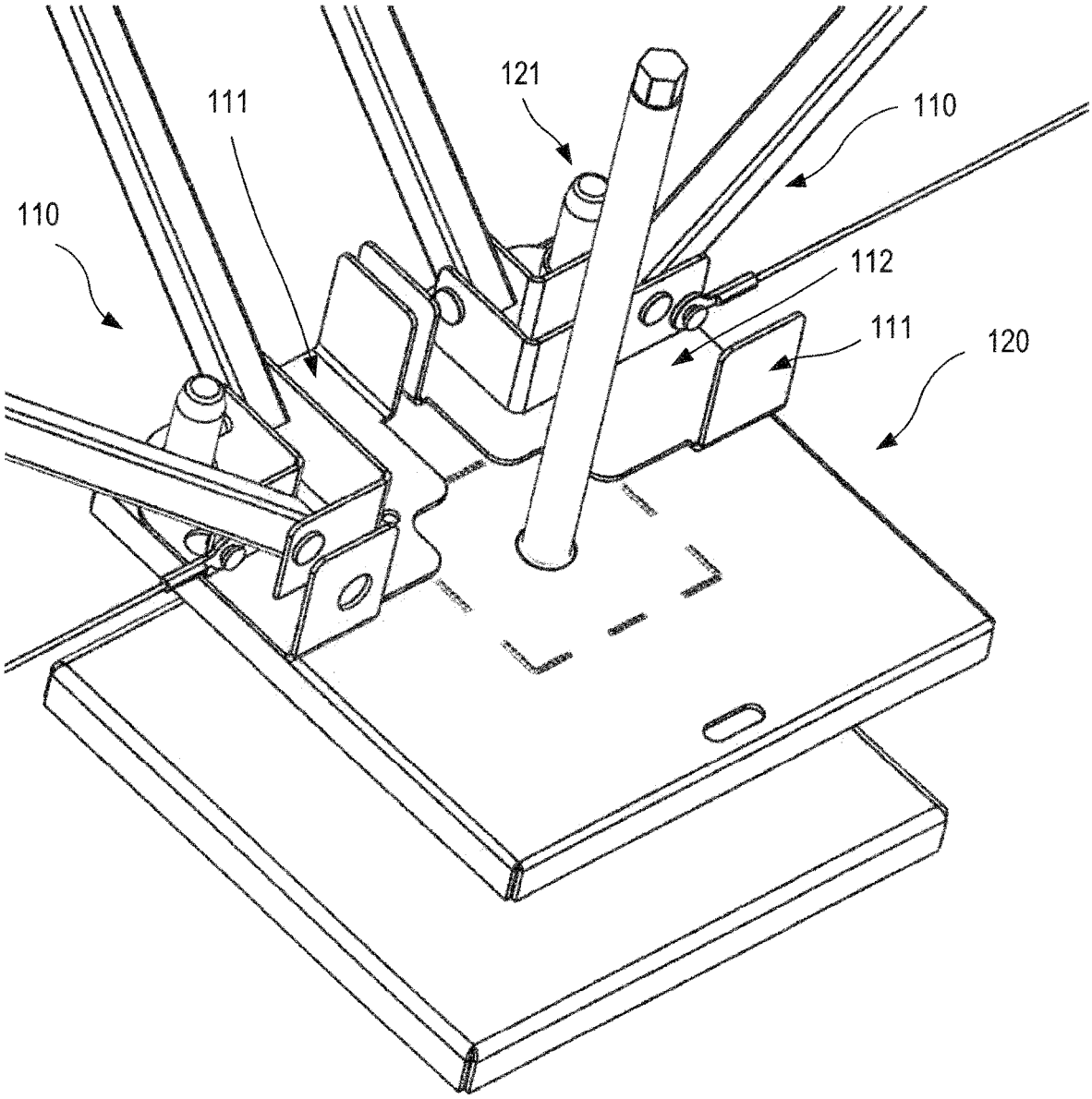
FIG. 4 illustrates aspects of a leveling pad assembly and a lower frame attachment mechanism according to certain embodiments of the invention.

As depicted in FIG. 2A, a stair pad assembly 160 can have a base 162, a post 164, and a support collar 166. FIG. 2B depicts aspects of a leveling pad assembly 120. As shown here, leveling pad assembly 120 includes pins 121, a base 122, a support 123, and a post 124. Next, two frame assemblies can be placed on the pad assemblies. For example, as depicted in FIG. 3, a lower frame attachment mechanism 111 of a frame assembly 110 can include a lower plate 112, and the lower plate 112 can have an aperture 115 configured to receive a pin of a leveling pad assembly. FIG. 4 shows a leveling pad assembly 120 having a pin 121 that extends through an aperture of a lower plate 112 of a lower frame attachment mechanism 111 of a frame assembly 110.

Figure 5A:
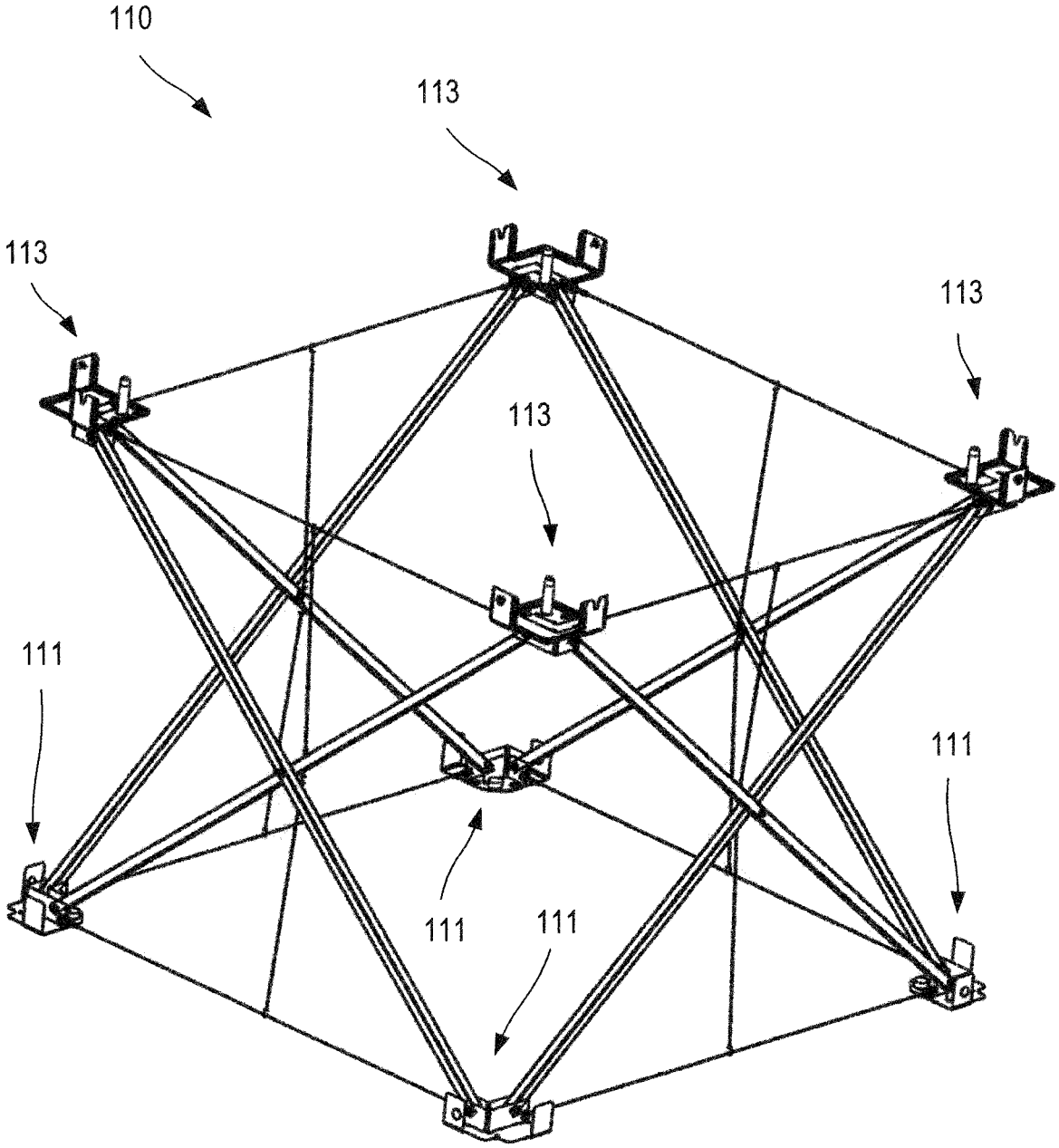
FIG. 5A illustrates aspects of a frame assembly according to certain embodiments of the invention.

FIG. 5A depicts aspects of a frame assembly 110, according to embodiments of the present invention. As shown here, the frame assembly 110 includes multiple (e.g. four) lower frame attachment mechanisms 111 and multiple (e.g. four) upper frame attachment mechanisms 113.

Figure 5B:
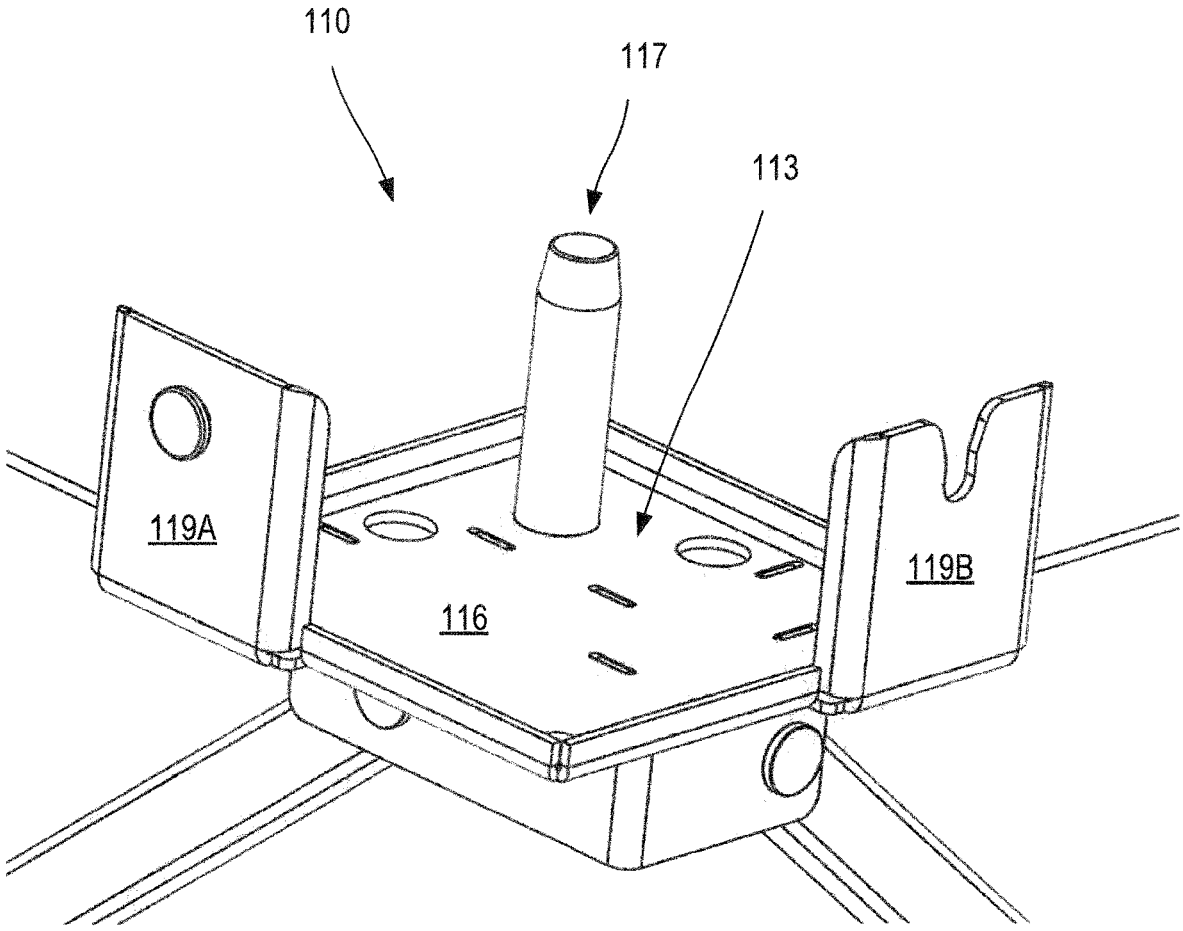
FIG. 5B illustrates aspects of an upper frame attachment mechanism of a frame assembly according to certain embodiments of the invention.

FIG. 5B depicts aspects of an upper frame attachment mechanism 1B of a frame assembly 110, according to embodiments of the present invention. Upper frame attachment mechanism 113 includes a support plate 116, a pin 117, and two tabs 119A and 1198.

Figure 5C:
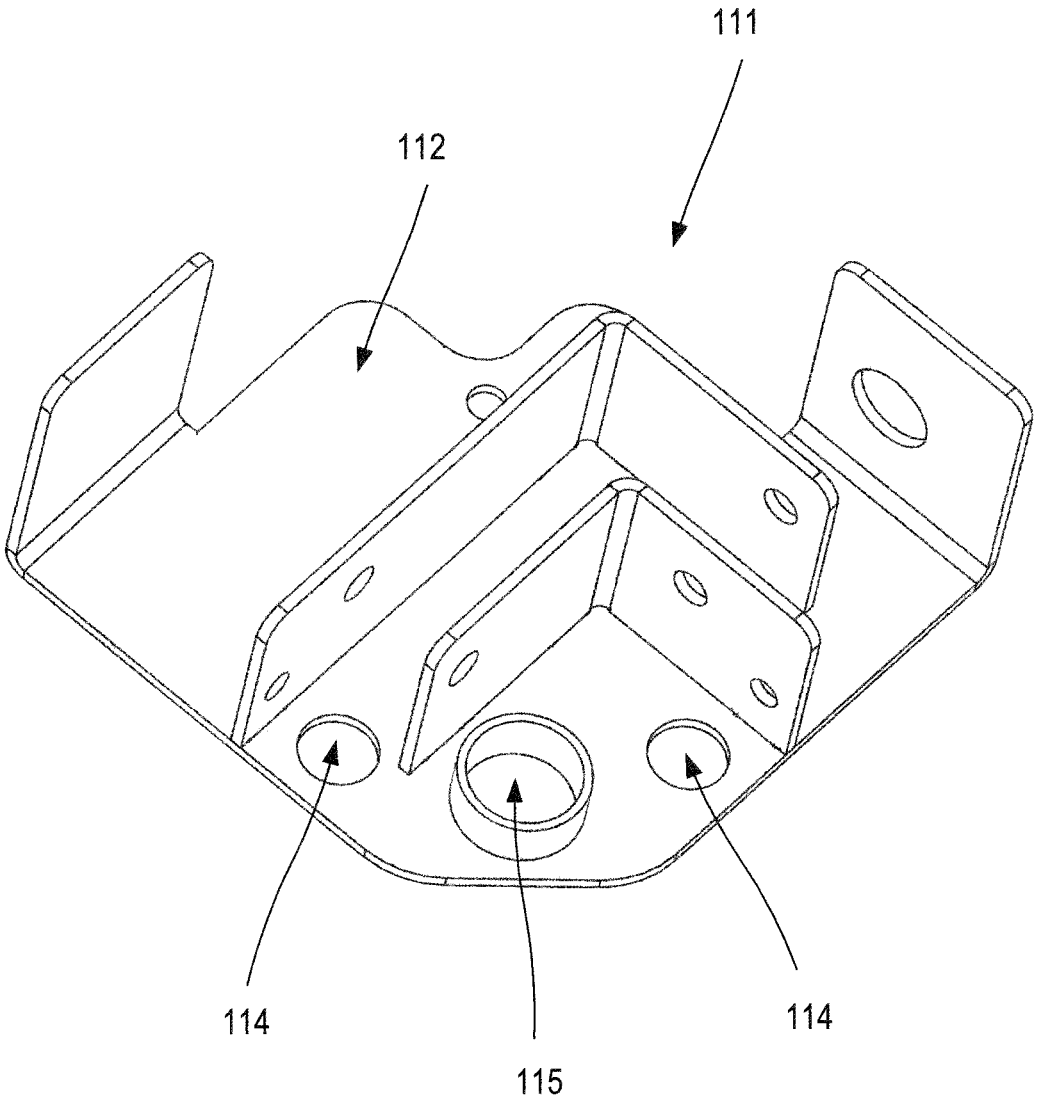
FIG. 5C illustrates aspects of a lower plate of a lower frame attachment mechanism of a frame assembly according to certain embodiments of the invention.

FIG. 5C depicts aspects of a lower plate 112 of a lower frame attachment mechanism 111 of a frame assembly, according to embodiments of the present invention. As shown here, lower plate 112 includes two lateral apertures 114 and a central aperture or sleeve 115. The method may also include confirming that the frame assemblies are level to ensure stability before putting a lower stair assembly in place.

Figure 6:
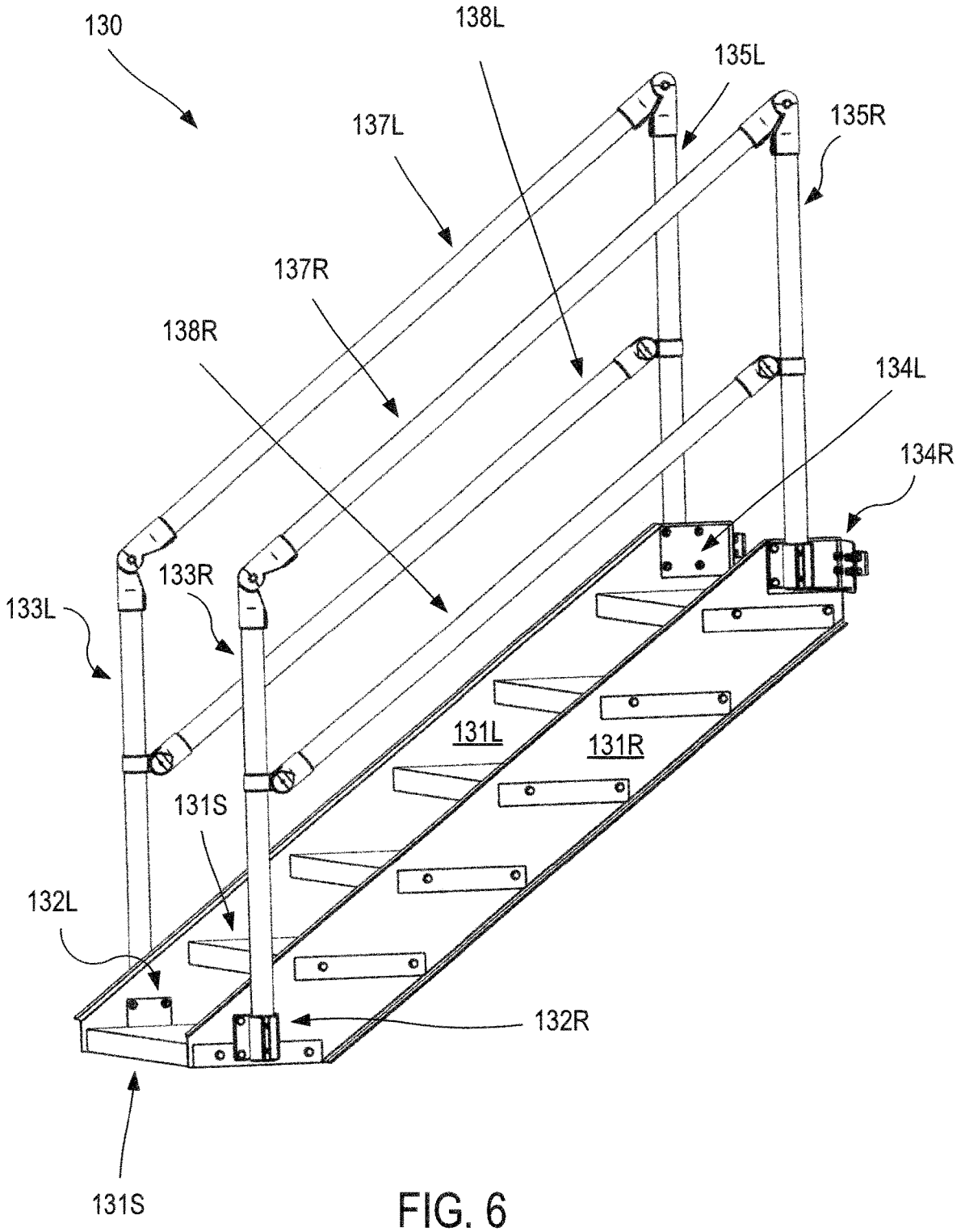
FIG. 6 illustrates aspects of a stair assembly according to certain embodiments of the invention.

FIG. 6 depicts aspects of a stair assembly 130 according to embodiments of the present invention. As shown here, stair assembly 130 includes a left stringer 131L, a right stringer 131R, and one or more steps 131S coupled between the stringers 131L, 131R. Stair assembly 130 also includes a left lower vertical railing 133L, a right lower vertical railing 133R, a left upper vertical railing 135L, a right upper vertical railing 135R, a left top railing 137L, a right top railing 137R, a left middle railing 138L, a right middle railing 138R, a left lower frame mount 132L, a right lower frame mount 132R, a left upper frame mount or mount rail support 134L, and a right upper frame mount or mount rail support 134R. The lower frame mounts 132L, 132R can be coupled with stair pad assemblies or a frame assembly, and the upper frame mounts 134L, 143R can be coupled with a frame assembly or a wall or a roof of a building or other structure.

Figure 7:
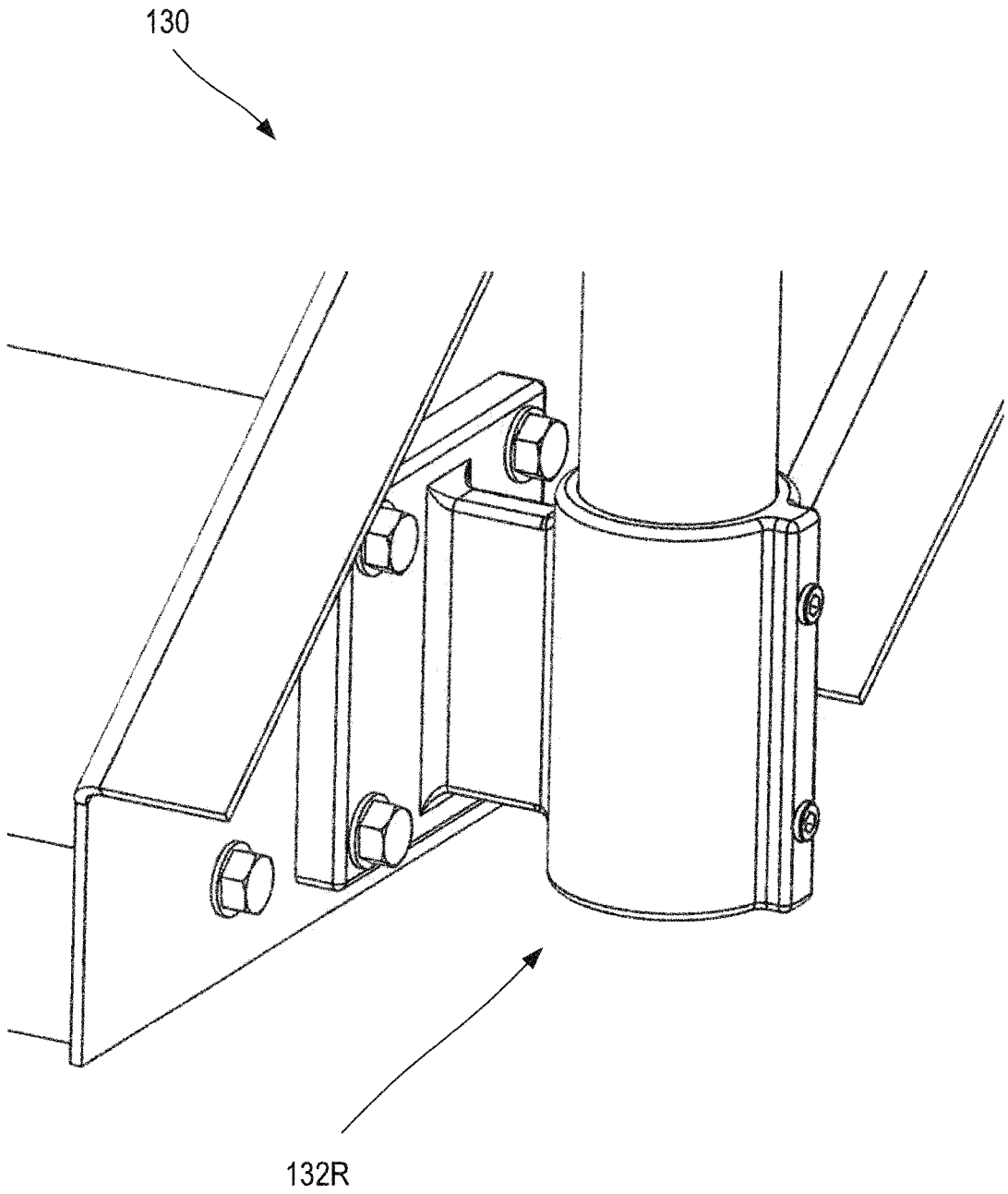
FIG. 7 illustrates aspects of a right lower frame mount of a stair assembly according to certain embodiments of the invention.

FIG. 7 depicts aspects of a right lower frame mount 132R of a stair assembly 130, according to embodiments of the present invention.

Figure 8:
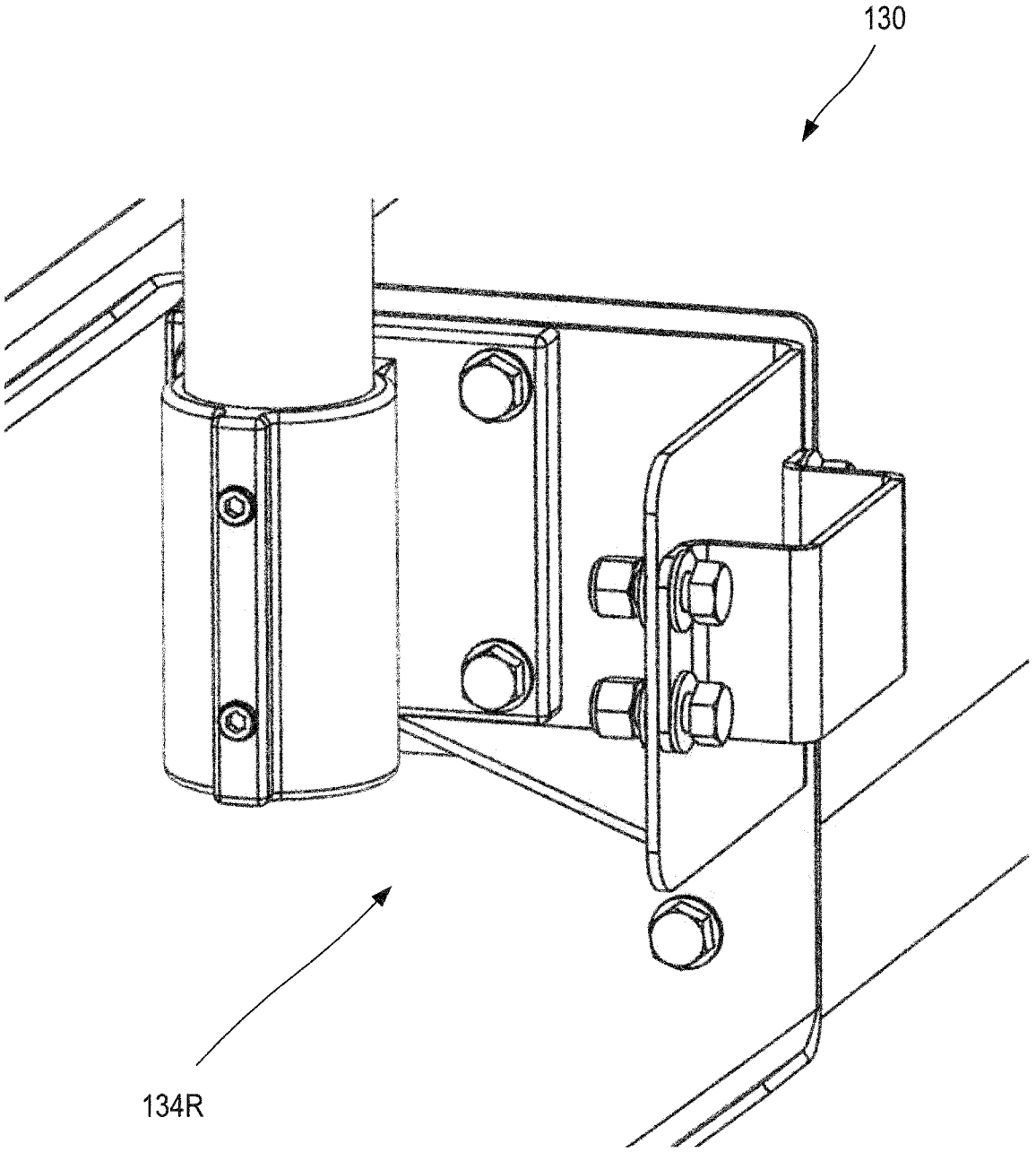
FIG. 8 illustrates aspects of a right upper frame mount of a stair assembly according to certain embodiments of the invention.

FIG. 8 depicts aspects of a right upper frame mount 134R of a stair assembly 130, according to embodiments of the present invention.

Figure 9:
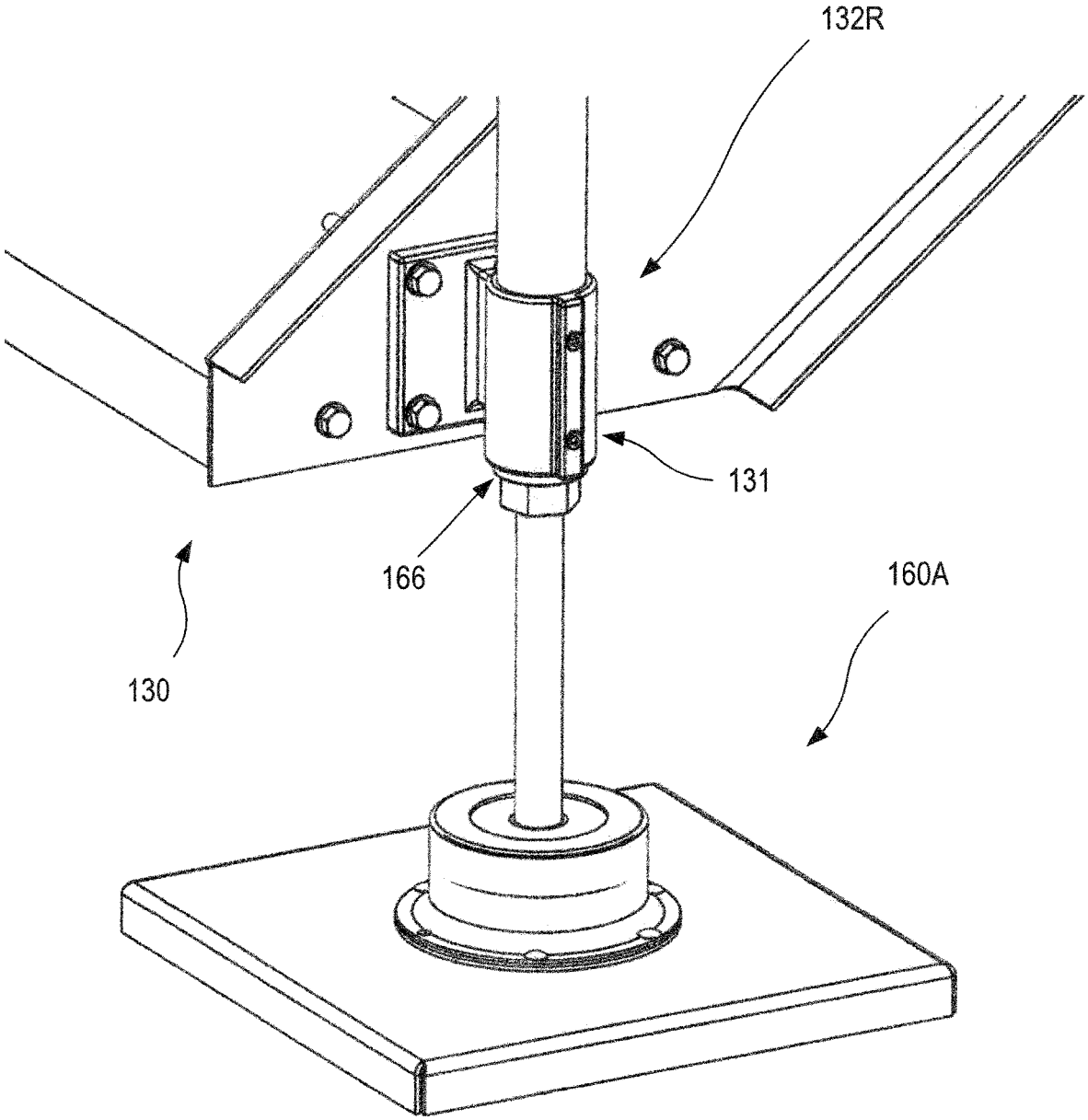
FIG. 9 illustrates aspects of a stair assembly and a stair pad assembly according to certain embodiments of the invention.

FIG. 9 depicts engagement of a stair assembly 130 with a stair pad assembly 160A via a right lower frame mount or mount rail support 132R. In some cases, stair assembly 130 can be a lower stair assembly 130. As shown here, stair assembly 130 includes a support collar 131 that is supported by or otherwise engages with a support collar 166 of the stair pad assembly 160A.

Figure 10:
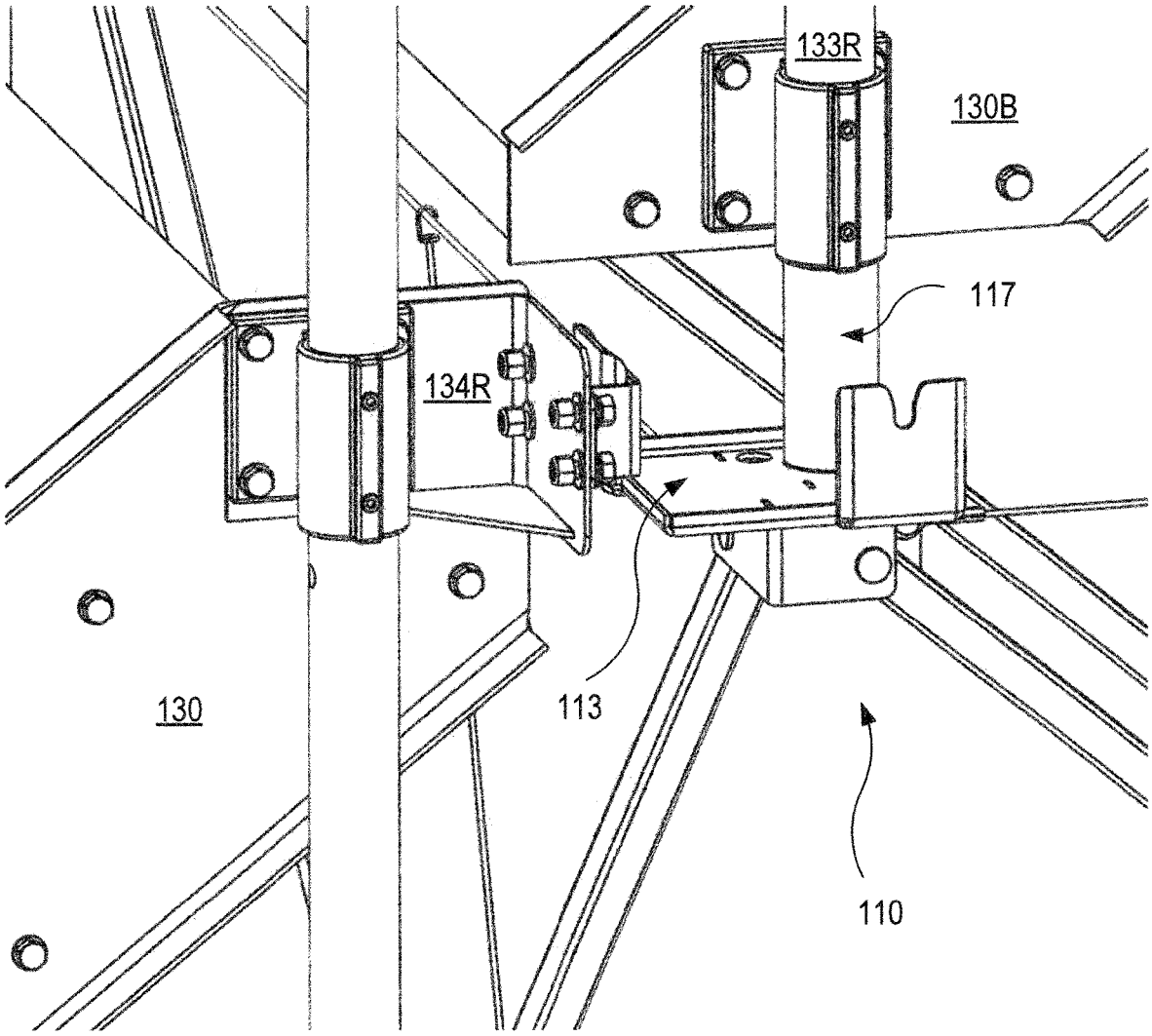
FIG. 10 illustrates aspects of an engagement of a frame assembly with two stair assemblies according to certain embodiments of the invention.

FIG. 10 depicts engagement of a stair assembly 130 with an upper frame attachment mechanism 113 of a frame assembly 110 via a right upper frame mount or mount rail support 134R of the stair assembly 130. In some cases, stair assembly 130 can be a lower stair assembly.

Figure 11:
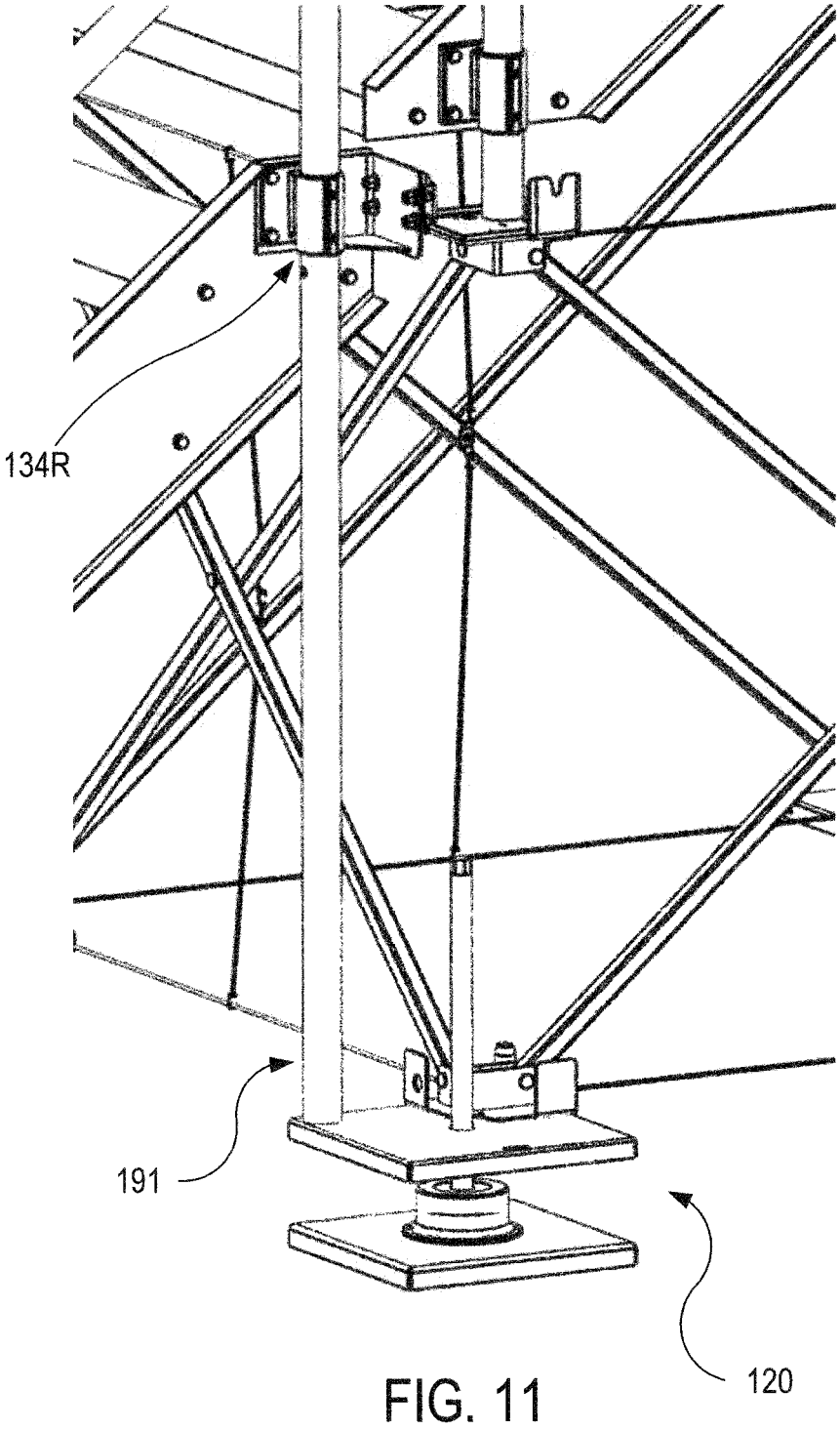
FIG. 11 illustrates aspects of a support leg, a leveling pad assembly, and a frame assembly according to certain embodiments of the invention.
Figure 12:
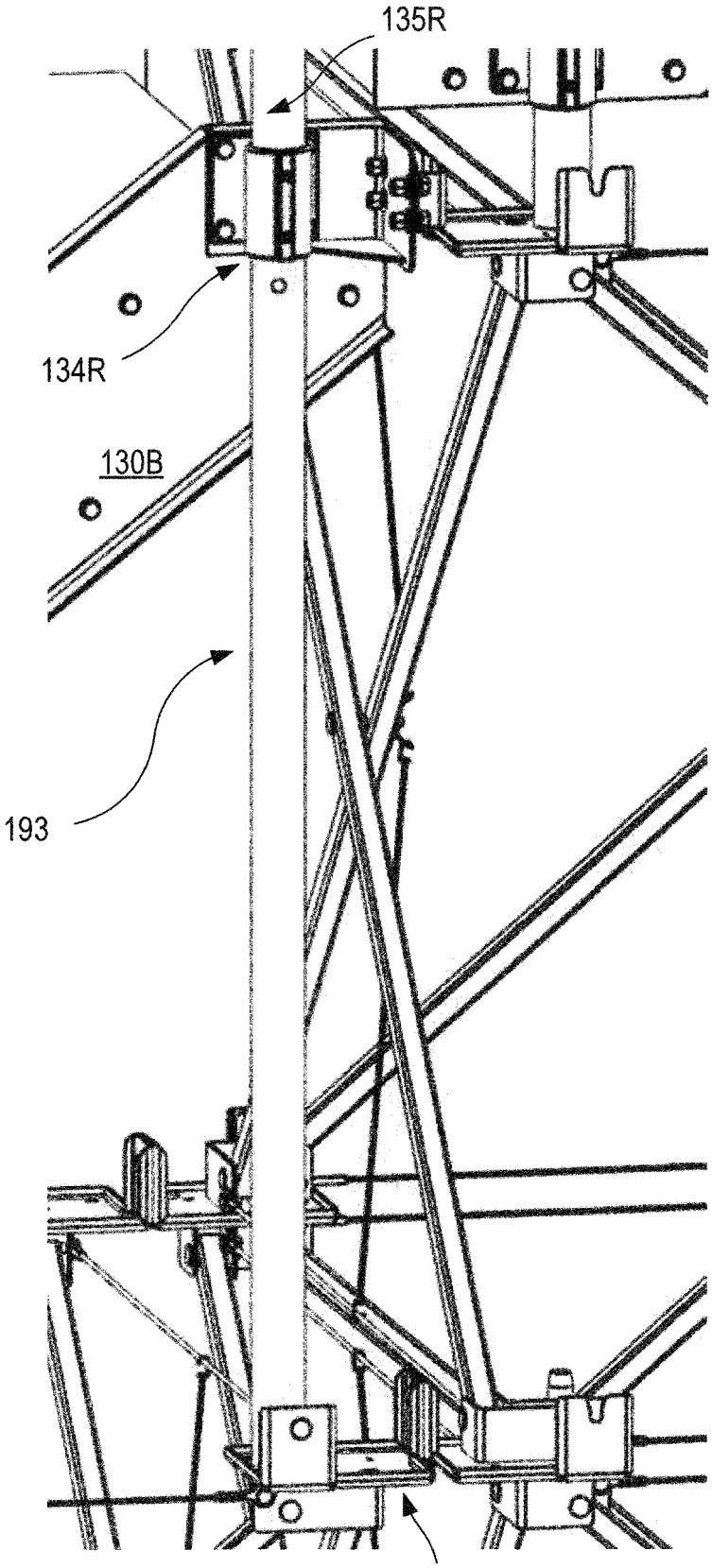
FIG. 12 illustrates aspects of a support leg according to certain embodiments of the invention.

In addition to positioning the lower two frame assemblies and lower stair assembly into place, methods of assembly can include positioning support legs for the middle stair assembly and upper frame assembly into position. For example, as depicted in FIG. 11, a right lower support leg 191 can be coupled with a leveling pad assembly 120 and a right upper frame mount 134R of a stair assembly (e.g. lower stair assembly). Relatedly, as depicted in FIG. 12, a right middle support leg 193 can be coupled with a lower frame attachment mechanism 111 of a frame assembly and a right upper frame mount 134R of a stair assembly (e.g. middle stair assembly 130B).

Figure 13:
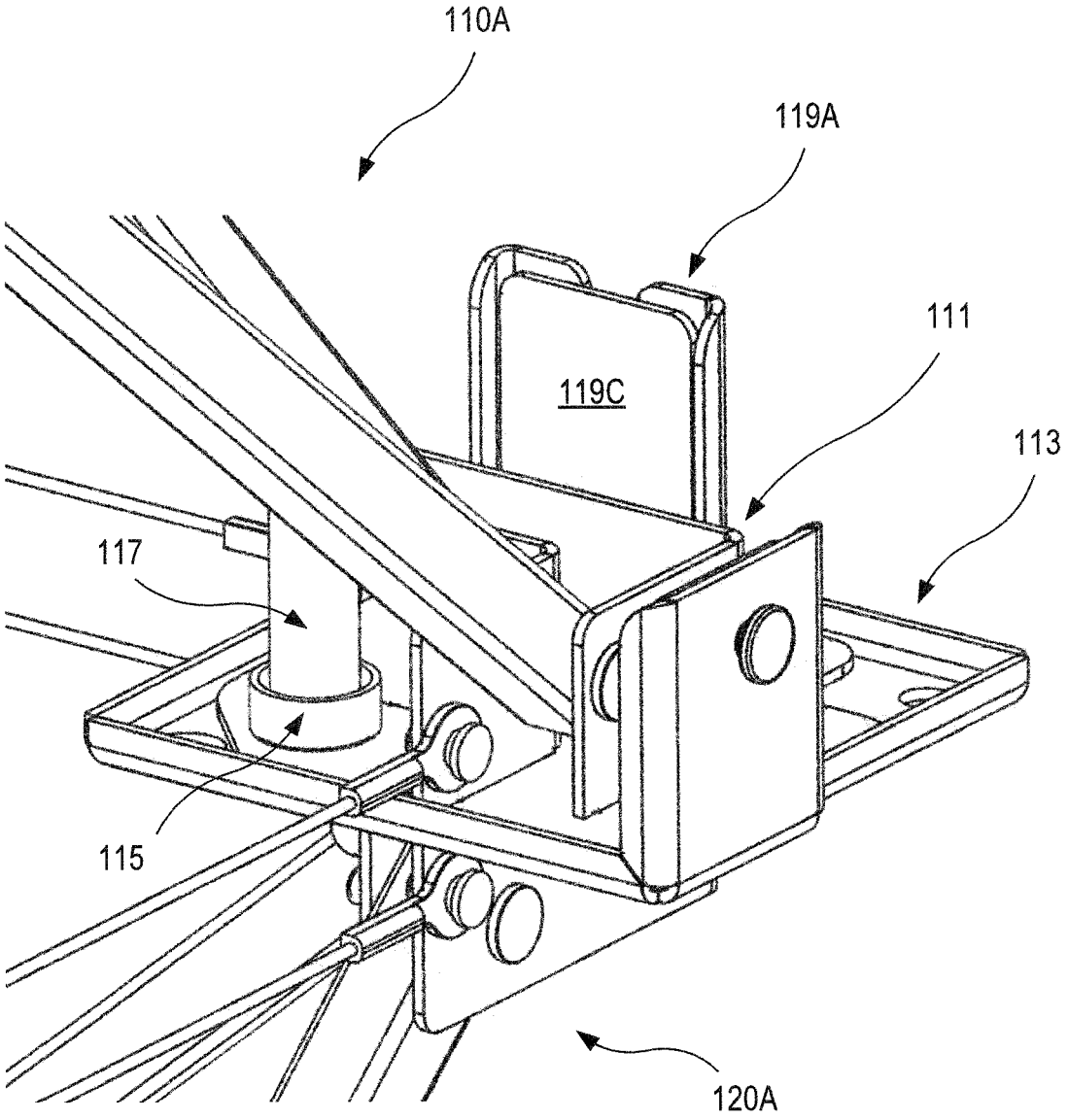
FIG. 13 illustrates aspects of a lower frame attachment mechanism of an upper frame assembly and an upper frame attachment mechanism of a lower frame assembly according to certain embodiments of the invention.

Further relatedly, as depicted in FIG. 13, an upper frame assembly 110A can be coupled with a lower frame assembly 1108 by coupling a lower frame attachment mechanism 111 of the upper frame assembly with an upper frame attachment mechanism 113 of the lower frame assembly. As shown here, a tab 119C of the lower frame attachment mechanism 111 engages a tab 119A of the upper frame attachment mechanism 113, and an aperture 115 of the lower frame attachment mechanism 111 receives a pin 117 of the upper frame attachment mechanism 113.

After the lower stair assembly, distal frame assembly, lower proximal frame assembly, and upper proximal frame assembly are in place, a middle stair assembly can be set in place. The support rails can be used to lift the middle stair assembly and to set it in place. As shown in FIG. 10, a right lower vertical railing 133R of the middle stair assembly 130B can be engaged or coupled with a pin 117 of an upper frame attachment mechanism 113 of the lower distal frame assembly 110. As shown in FIG. 12, a right upper vertical railing 135R of the middle stair assembly 130B can be engaged or coupled with middle support leg 193.

Figure 14:
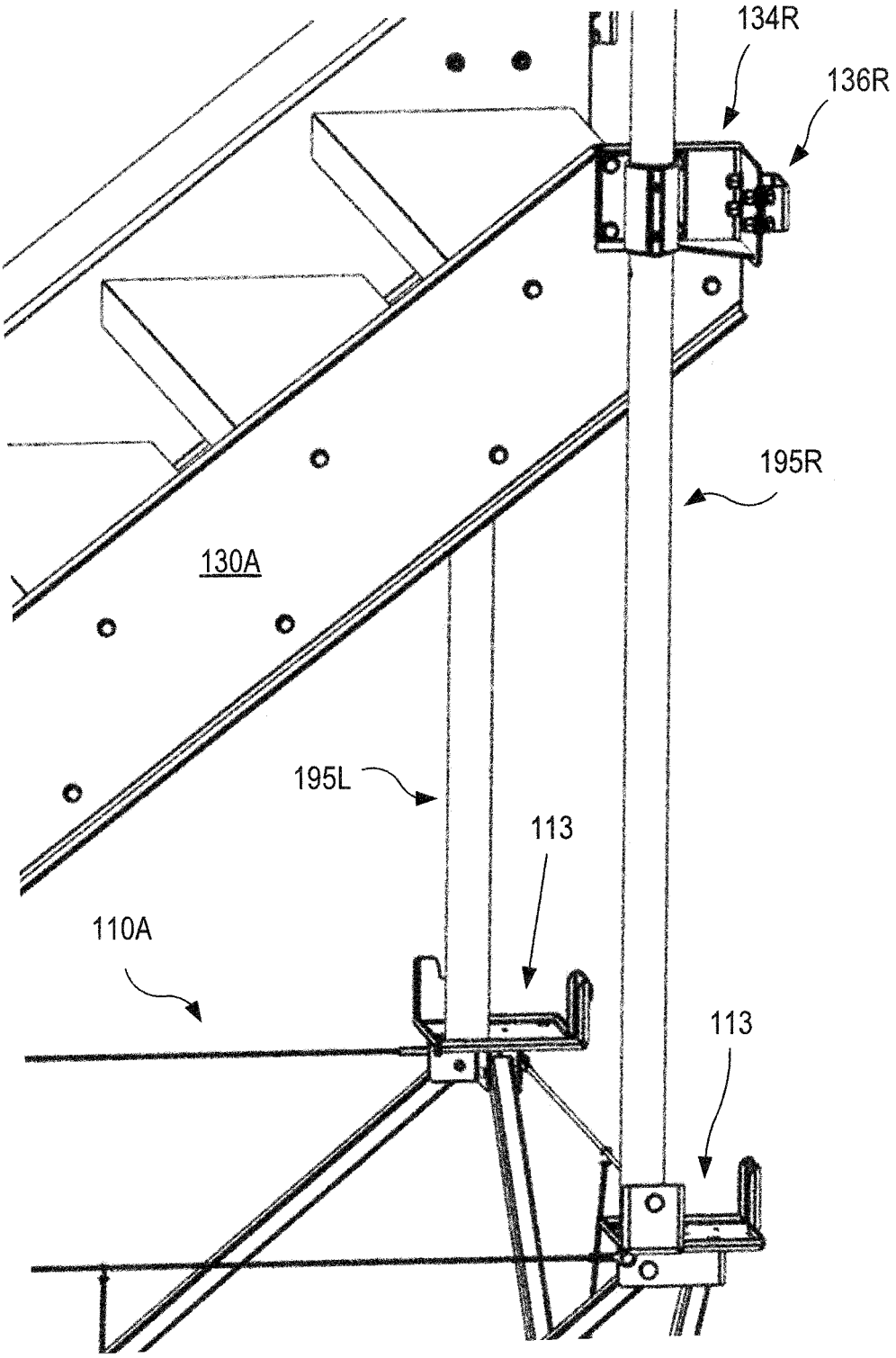
FIG. 14 illustrates aspects of support legs according to certain embodiments of the invention.

After the middle stair assembly is in place, support legs for the upper stair assembly and upper panel stair adapter brackets can be set in place. For example, as depicted in FIG. 14, a right upper support leg 195R and a left upper support leg 195L can be coupled with respective upper frame attachment mechanisms 113 of upper proximal frame assembly 110A.

Figure 15:
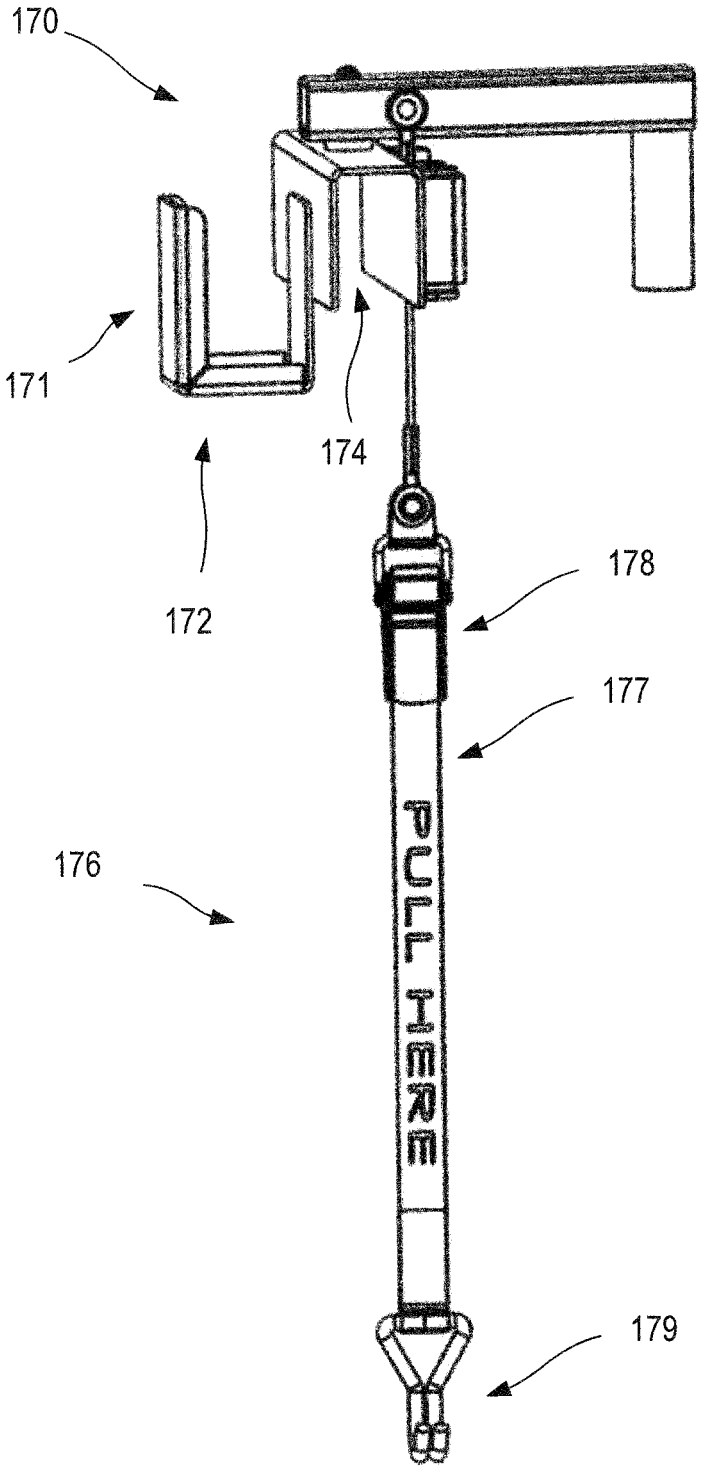
FIG. 15 illustrates aspects of an upper panel bracket assembly according to certain embodiments of the invention.

The right upper frame mount 134R of stair assembly 130A includes a sleeve or attachment mechanism 136R that can be coupled with a stair adapter bracket of an upper panel bracket assembly. For example, as depicted in FIG. 15, an upper panel bracket assembly 170 includes a stair adapter bracket 172 having a tab 171 that can be inserted into the sleeve (sleeve 136R in FIG. 14). Upper panel bracket assembly 170 also includes a wall adapter bracket 174 that can be placed over the top edge of a wall of a structure, such as a modular protective system, an overhead cover systems, or the like. In this way, the upper panel bracket assembly 170 can operate as a connector between a stair assembly and a wall of a building or structure. Relatedly, the stair adapter bracket 172 can operate as a connector between a wall adapter bracket 174 and a stair assembly. After the support legs for the upper stair assembly and the upper panel stair adapter brackets are in place, the upper stair assembly can be set in place.

According to some embodiments, an upper panel bracket assembly 170 can include a tensioning mechanism 176 having a tension strap 177 with a locking cam 178 and a hook 179. In use, the tensioning mechanism 176 can operate to help keep the wall adapter bracket 174 connected or engaged with a wall or a portion of a wall or structure, such as a modular protective system (MPS) wall frame. The wall adapter bracket 174 can help to keep armor panels in place on a modular protective system during a dynamic event, such as a blast. As shown here, a wall adapter bracket 174 can be coupled with or extended with a stair adapter bracket 172 having a tab 171. In some embodiments, the stair adapter bracket 172 and/or tab 171 can help to restrain the upper steps of a stair assembly to the top of a modular protective system. This feature can provide additional stability and continuity between the modular protective system wall and the upper end of the stair assembly.

Exemplary frame and stair system embodiments are well suited for use with modular protective systems and related overhead cover systems such as those disclosed in previously incorporated U.S. Patent Publication No. 2011/0005695, U.S. Patent Publication No. 2014/0130438, and/or U.S. Pat. No. 8,464,493. Frame and stair system embodiments provide modular structures to fit modular protective system walls having heights such as 4 feet, 8 feet, or 12 feet. In some embodiments, individual components of frame and stair system embodiments can be shipped to a construction site or location in an intermodal or ISO container. An exemplary frame and stair system kit can include three modular protective system frames or frame assemblies and six leveling pads, among other components disclosed herein. In some cases, a frame and stair system embodiment can be assembled without the use or requirement of special tools. In some cases, a frame and stair system can be installed as part of a modular protective and overhead cover system. In some cases, a frame and stair system can provide safe access to the top of a modular protective system wall, so as to facilitate completion of the installation of a modular protective and overhead cover system.

The use of frame and stair system embodiments as disclosed herein can help to prevent or reduce fall hazards that may be associated with construction of a modular protective system wall. In some cases, frame and stair system embodiments as disclosed herein can use the same or similar frames or frame assemblies such as those used in modular protective systems and/or overhead cover systems. In some cases, frame and stair system embodiments as disclosed herein can use the same or similar pad assemblies or bases (e.g. adjustable bases) such as those used in modular protective systems and/or overhead cover systems. Hence, a frame and stair system kit can include many of the same pieces that are used for constructing a wall section of a modular protective system and/or overhead cover system, and use of a frame and stair system can assist with either safely constructing the wall or being a permanent or semi-permanent access stair.

In some embodiments, because the same frame assemblies can be used, a stair and frame assembly can be made exactly the same height as each successive wall section that is being erected, an exemplary maximum height typically being three levels. Hence, regardless of the height of the wall being constructed, or the height needed to perform the wall assembly, the stair section can be the exact correct height to assist with the safe construction of the modular protective wall system.

As will be appreciated by one of ordinary skill in the art, the present invention may be embodied as an apparatus (including, for example, a system, a machine, a device, and/or the like), as a method (including, for example, a business process, and/or the like), or as any combination of the foregoing.

Embodiments of the invention can be manifest in the form of methods and apparatuses for practicing those methods.

Unless explicitly stated otherwise, each numerical value and range should be interpreted as being approximate as if the word "about" or "approximately" preceded the value or range.

Unless otherwise indicated, all numbers expressing quantities of ingredients, properties such as molecular weight, percent, ratio, reaction conditions, and so forth used in the specification and claims are to be understood as being modified in all instances by the term "about," whether or not the term "about" is present. Accordingly, unless indicated to the contrary, the numerical parameters set forth in the specification and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements.

It will be further understood that various changes in the details, materials, and arrangements of the parts which have been described and illustrated in order to explain embodiments of this invention may be made by those skilled in the art without departing from embodiments of the invention encompassed by the following claims.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

All documents mentioned herein are hereby incorporated by reference in their entirety or alternatively to provide the disclosure for which they were specifically relied upon.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

What is claimed is:

1. A frame and stair system that engages with a wall of a modular protective system, the frame and stair system being oriented from distal to proximal in which proximal is closer to the wall than distal, the frame and stair system being oriented with left and right viewing from distal to proximal, the frame and stair system comprising:

a left stair pad assembly and a right stair pad assembly;

a left distal leveling pad assembly, a right distal leveling pad assembly, a left middle leveling pad assembly, a right middle leveling pad assembly, a left proximal leveling pad assembly, and a right proximal leveling pad assembly;

a distal frame assembly, a lower proximal frame assembly, and an upper proximal frame assembly;

a lower stair assembly, a middle stair assembly, and an upper stair assembly;

a left lower support leg, a right lower support leg, a left middle support, leg, a right middle support leg, a left upper support leg, and a right upper support leg; and an upper panel bracket assembly including a left upper panel stair adapter bracket attached to a left wall adapter bracket to engage an upper edge of the wall and a right upper panel stair adapter bracket attached to a right wall adapter bracket to engage the upper edge of the wall, wherein the lower stair assembly is coupled with the left stair pad assembly and the right stair pad assembly, with the left distal leveling pad assembly via the left lower support leg, and with the right distal leveling pad assembly via the right lower support leg, wherein the middle stair assembly is coupled with the distal frame assembly, wherein the upper proximal frame assembly is positioned between and coupled with the upper stair assembly and the lower proximal frame assembly, and wherein the left upper panel stair adapter bracket and the right upper panel stair adapter bracket are coupled with the upper stair assembly and are configured to engage the wall of the modular protective system, the upper stair assembly including a left upper frame mount having a left upper sleeve to be coupled to the left upper panel stair adapter bracket and a right upper frame mount having a right upper sleeve to be coupled to the right upper panel stair adapter bracket.

2. The frame and stair system according to claim 1, wherein the lower proximal frame assembly comprises a right proximal upper frame attachment mechanism, a left proximal upper frame attachment mechanism, a right distal upper frame attachment mechanism, and a left distal upper frame attachment mechanism, and wherein the upper proximal frame assembly comprises a right proximal lower frame attachment mechanism, a left proximal lower frame attachment mechanism, a right distal lower frame attachment mechanism, and a left distal lower frame attachment mechanism, wherein the right proximal upper frame attachment mechanism of the lower proximal frame assembly attaches with the right proximal lower frame attachment mechanism of the upper proximal frame assembly, the left proximal upper frame attachment mechanism of the lower proximal frame assembly attaches with the left proximal lower frame attachment mechanism of the upper proximal frame assembly, the right distal upper frame attachment mechanism of the lower proximal frame assembly attaches with the right distal lower frame attachment mechanism of the upper proximal frame assembly, and the left distal upper frame attachment mechanism of the lower proximal frame assembly attaches with the left distal lower frame attachment mechanism of the upper proximal frame assembly.

3. The frame and stair system according to claim 1, wherein the right lower support leg is coupled with the right distal leveling pad via a right lower frame mount and the left lower support leg is coupled with the left distal leveling pad via a left lower frame mount.

4. The frame and stair system according to claim 3, wherein the lower proximal frame assembly comprises a right proximal lower frame attachment mechanism, a left proximal lower frame attachment mechanism, a right distal lower frame attachment mechanism, and a left distal lower frame attachment mechanism, and wherein the right proximal lower frame attachment mechanism comprises an aperture that receives a pin of the right proximal leveling pad assembly, the left proximal lower frame attachment mechanism comprises an aperture that receives a pin of the left proximal leveling pad assembly, the right distal lower frame attachment mechanism comprises an aperture that receives a pin of the right middle leveling pad assembly, and the left distal lower frame attachment mechanism comprises an aperture that receives a pin of the left middle leveling pad assembly.

5. The frame and stair system according to claim 1, wherein the upper proximal frame assembly comprises a right proximal lower frame attachment mechanism and a left proximal lower frame attachment mechanism, wherein the lower proximal frame assembly comprises a right proximal upper frame attachment mechanism and a left proximal upper frame attachment mechanism, wherein the right proximal lower frame attachment mechanism of the upper proximal frame assembly comprises an aperture that receives a pin of the right proximal upper frame attachment mechanism of the lower proximal frame assembly, and wherein the left proximal lower frame attachment mechanism of the upper proximal frame assembly comprises an aperture that receives a pin of the left proximal upper frame attachment mechanism of the lower proximal frame assembly.

6. The frame and stair system according to claim 1, wherein the lower proximal frame assembly comprises a right distal lower frame attachment mechanism and a left distal lower frame attachment mechanism, the right distal lower frame attachment mechanism having an aperture that receives a proximal pin of the right middle leveling pad assembly and the left distal lower frame attachment mechanism having an aperture that receives a proximal pin of the left middle leveling pad assembly, and wherein the distal frame assembly comprises a right proximal lower frame attachment mechanism and a left proximal lower frame attachment mechanism, the right proximal lower frame attachment mechanism having an aperture that receives a distal pin of the right middle leveling pad assembly and the left proximal lower frame attachment mechanism having an aperture that receives a distal pin of the left middle leveling pad assembly.

7. The frame and stair system according to claim 1, wherein the right lower support leg is engaged with a distal pin of the right distal leveling pad assembly and the left lower support leg is engaged with a distal pin of the left distal leveling pad assembly.

8. The frame and stair system according to claim 1, wherein the right lower support leg is coupled with the lower stair assembly via a right upper frame mount and the left lower support leg is coupled with the lower stair assembly via a left upper frame mount.

9. The frame and air system according to claim 1, wherein the left upper panel stair adapter bracket has a left tab to be coupled with the left upper sleeve of the left upper frame mount of the upper stair assembly and wherein the right upper panel stair adapter bracket has a right tab to be coupled with the right upper sleeve of the right upper frame mount of the upper stair assembly.

10. The frame and air system according to claim 9, wherein the left wall adapter bracket has an inverted U-shape to engage the upper edge of the wall, the left upper panel stair adapter bracket has an upright U-shape with the left tab to receive the left upper sleeve, the right wall adapter bracket has an inverted U-shape to engage the upper edge of the wall, and the right upper panel stair adapter bracket has an upright U-shape with the right tab to receive the right upper sleeve.

11. The frame and air system according to claim 1, wherein the upper panel bracket assembly further includes a left tensioning mechanism coupled with the left wall adapter bracket and a right tensioning mechanism coupled with the right wall adapter bracket, the left tensioning mechanism having a left tension strap with a left locking cam and a left hook, the right tensioning mechanism having a right tension strap with a right locking cam and a right hook.

12. A frame and stair system that engages with a wall the system being oriented from distal to proximal in which proximal is closer to the wall than distal, the system being oriented with left and right viewing from distal to proximal, the system comprising:

a left stair pad assembly and a right stair pad assembly;

a left distal leveling pad assembly, a right distal leveling pad assembly, a left middle leveling pad assembly, a right middle leveling pad assembly, a left proximal leveling pad assembly, and a right proximal leveling pad assembly;

a distal frame assembly, a lower proximal frame assembly, and an upper proximal frame assembly;

a lower stair assembly, a middle stair assembly, and an upper stair assembly; and an upper panel bracket assembly including a left upper panel stair adapter bracket attached to a left wall adapter bracket to engage an upper edge of the wall and a right upper panel stair adapter bracket attached to a right wall adapter bracket to engage the upper edge of the wall, a left upper panel stair adapter bracket and a right upper panel stair adapter bracket, wherein the lower stair assembly is coupled with the left stair pad assembly, the right stair pad assembly, the left distal leveling pad, and the right distal leveling pad, wherein the middle stair assembly is coupled with the distal frame assembly and the upper proximal frame assembly, wherein the upper stair assembly is coupled with the upper proximal frame assembly, wherein the upper proximal frame assembly is coupled with the lower proximal frame assembly, and wherein the left upper panel stair adapter bracket and the right upper panel stair adapter bracket are coupled with the upper stair assembly and are configured to engage an upper edge of the wall, the upper stair assembly including a left upper frame mount having a left upper sleeve to be coupled to the left upper panel stair adapter bracket and a right upper frame mount having a right upper sleeve to be coupled to the right upper panel stair adapter bracket.

13. The system according to claim 12, wherein the distal frame assembly is coupled with the left distal leveling pad assembly, the right distal leveling pad assembly, the left middle leveling pad assembly, and the right middle leveling pad assembly.

14. The system according to claim 12, wherein the lower proximal frame assembly is coupled with the left middle leveling pad assembly, the right middle leveling pad assembly, the left proximal leveling pad assembly, and the right proximal leveling pad assembly.

15. The system according to claim 12, wherein the lower stair assembly is coupled with the left distal leveling pad assembly via a left lower support leg, and with the right distal leveling pad assembly via a right lower support leg.

16. A method of assembling a frame and stair system that engages with a wall of a modular protective system, the frame and stair system being oriented from distal to proximal in which proximal is closer to the wall than distal, the frame and stair system being oriented with left and right viewing from distal to proximal, the method comprising:

placing a left stair pad assembly, a right stair pad assembly, a left distal leveling pad assembly, a right distal leveling pad assembly, a left middle leveling pad assembly, a right middle leveling pad assembly, a left proximal leveling pad assembly, and a right proximal leveling pad assembly on a ground surface;

coupling a right lower support leg with the right distal leveling pad assembly and a left lower support leg with the left distal leveling pad assembly;

coupling a lower stair assembly with the left stair pad assembly, the right stair pad assembly, the left lower support leg, and the right lower support leg;

coupling a distal frame assembly with the left distal leveling pad assembly, the right distal leveling pad assembly, the left middle leveling pad assembly, and the right middle leveling pad assembly;

coupling a lower proximal frame assembly with the left middle leveling pad assembly, the right middle leveling pad assembly, the left proximal leveling pad assembly, and the right proximal leveling pad assembly;

coupling a right middle support leg with the distal frame assembly and a left middle support leg with the distal frame assembly;

coupling a middle stair assembly with the right middle support leg and the left middle support leg;

coupling an upper proximal frame assembly with the lower proximal frame assembly;

coupling a right upper support leg with the upper proximal frame assembly and a left upper support leg with the upper proximal frame assembly;

coupling an upper stair assembly with the right upper support leg and the left upper support leg; and coupling a left upper panel stair adapter bracket and a right upper panel stair adapter bracket of an upper panel bracket assembly with the upper stair assembly, wherein the left upper panel stair adapter bracket and the right upper panel stair adapter bracket are configured to engage, respectively, a left wall adapter bracket to engage an upper edge of the wall and a right wall adapter bracket to engage the upper edge of the wall of the modular protective system, the upper stair assembly including a left upper frame mount having a left upper sleeve to be coupled to the left upper panel stair adapter bracket and a right upper frame mount having a right upper sleeve to be coupled to the right upper panel stair adapter bracket.

17. The method according to claim 16, wherein the lower proximal frame assembly comprises a right proximal upper frame attachment mechanism, a left proximal upper frame attachment mechanism, a right distal upper frame attachment mechanism, and a left distal upper frame attachment mechanism, and wherein the upper proximal frame assembly comprises a right proximal lower frame attachment mechanism, a left proximal lower frame attachment mechanism, a right distal lower frame attachment mechanism and a left distal lower frame attachment mechanism, the method further comprising coupling the right proximal upper frame attachment mechanism of the lower proximal frame assembly with the right proximal lower frame attachment mechanism of the upper proximal frame assembly, coupling the left proximal upper frame attachment mechanism of the lower proximal frame assembly with the left proximal lower frame attachment mechanism of the upper proximal frame assembly, coupling the right distal upper frame attachment mechanism of the lower proximal frame assembly with the right distal lower frame attachment mechanism of the upper proximal frame assembly, and coupling the left distal upper frame attachment mechanism of the lower proximal frame assembly with the left distal lower frame attachment mechanism of the upper proximal frame assembly.

18. The method according to claim 16, comprising coupling the right lower support leg with the right distal leveling pad via a right lower frame mount and coupling the left lower support leg with the left distal leveling pad via a left lower frame mount.

19. The according to claim 16, wherein the lower proximal frame assembly comprises a right proximal lower frame attachment mechanism, a left proximal lower frame attachment mechanism, a right distal lower frame attachment mechanism, and a left distal lower frame attachment mechanism, the method further comprising placing an aperture of the right proximal lower frame attachment mechanism over a pin of the right proximal leveling pad assembly, placing an aperture of the left proximal lower frame attachment mechanism over a pin of the left proximal leveling pad assembly, placing an aperture of the right distal lower frame attachment mechanism over a pin of the right middle leveling pad assembly, and placing an aperture of the left distal lower frame attachment mechanism over a pin of the left middle leveling pad assembly.

20. The method according to claim 16, wherein the upper proximal frame assembly comprises a right proximal lower frame attachment mechanism and a left proximal lower frame attachment mechanism, and he lower proximal frame assembly comprises a right proximal upper frame attachment mechanism and a left proximal upper frame attachment mechanism, the method further comprising placing an aperture of the right proximal lower frame attachment mechanism of the upper proximal frame assembly over a pin of the right proximal upper frame attachment mechanism of the lower proximal frame assembly, and placing an aperture of the left proximal lower frame attachment mechanism of the upper proximal frame assembly over a pin of the left proximal upper frame attachment mechanism of the lower proximal frame assembly.

21. The method according to claim 16, wherein the lower proximal frame assembly comprises a right distal lower frame attachment mechanism and a left distal lower frame attachment mechanism, and the distal frame assembly comprises a right proximal lower frame attachment mechanism and a left proximal lower frame attachment mechanism, the method further comprising placing an aperture of the right distal lower frame attachment mechanism over a proximal pin of the right middle leveling pad assembly, placing an aperture of the left distal lower frame attachment mechanism over a proximal pin of the left middle leveling pad assembly, placing an aperture of the right proximal lower frame attachment mechanism over a distal pin of the right middle leveling pad assembly, and placing an aperture of the left proximal lower frame attachment mechanism over a distal pin of the left middle leveling pad assembly.

22. The method according to claim 16, comprising engaging the right lower support leg with a distal pin of the right distal leveling pad assembly, and engaging the left lower support leg with a distal pin of the left distal leveling pad assembly.

23. The method according to claim 16, comprising coupling the right lower support leg with the lower stair assembly via a right upper frame mount, and coupling the left lower support leg with the lower stair assembly via a left upper frame mount.

* * * * *